US009375121B2

(12) United States Patent
Coesel

(10) Patent No.: US 9,375,121 B2
(45) Date of Patent: Jun. 28, 2016

(54) VACUUM HOSE STORAGE SYSTEM

(71) Applicant: Tiger Tool International Incorporated, Abbotsford (CA)

(72) Inventor: Remco Coesel, Abbotsford (CA)

(73) Assignee: Tiger Tool International Incorporated, Abbotsford (CA)

( * ) Notice: Subject to any disclaimer, the term of this patent is extended or adjusted under 35 U.S.C. 154(b) by 0 days.

(21) Appl. No.: 14/388,716

(22) PCT Filed: Mar. 25, 2013

(86) PCT No.: PCT/CA2013/050245

§ 371 (c)(1),
(2) Date: Sep. 26, 2014

(87) PCT Pub. No.: WO2013/142992

PCT Pub. Date: Oct. 3, 2013

(65) Prior Publication Data

US 2015/0047144 A1 Feb. 19, 2015

Related U.S. Application Data

(60) Provisional application No. 61/616,367, filed on Mar. 27, 2012.

(51) Int. Cl.

| | |
|---|---|
| ***A47L 5/38*** | (2006.01) |
| ***A47L 9/24*** | (2006.01) |
| ***A47L 9/00*** | (2006.01) |
| ***B65H 75/36*** | (2006.01) |

(52) U.S. Cl.

CPC . *A47L 9/248* (2013.01); *A47L 5/38* (2013.01); *A47L 9/0063* (2013.01); *B65H 75/362* (2013.01); *B65H 2701/33* (2013.01); *Y10T 29/49716* (2015.01)

(58) Field of Classification Search

CPC ..... A47L 5/38; A47L 9/0063; A47L 9/248; B65H 75/362; B65H 2701/33; Y10T 29/49716
USPC ..... 15/323
IPC ..... A47L 5/38
See application file for complete search history.

(56) References Cited

U.S. PATENT DOCUMENTS

| | | | | |
|---|---|---|---|---|
| 2,718,655 | A * | 9/1955 | Cymara | A47L 9/0036 15/246.2 |
| 2,953,806 | A | 9/1960 | Walker | |
| 3,027,588 | A | 4/1962 | Bierstock | |

(Continued)

FOREIGN PATENT DOCUMENTS

| | | | |
|---|---|---|---|
| CA | 675552 | A | 12/1963 |
| JP | 2000342363 | A | 12/2000 |

(Continued)

*Primary Examiner* — David Redding
(74) *Attorney, Agent, or Firm* — Michael R. Schacht; Schacht Law Office, Inc.

(57) ABSTRACT

A vacuum hose storage system comprises a vacuum unit, a storage tube, and a vacuum hose. The vacuum unit is fluidly connected to the storage tube, and is operable to generate a partial vacuum within the storage tube. The vacuum hose can be draw in into the storage tube by the partial vacuum. The vacuum hose can be removed from the storage tube and connected to an inlet to provide a partial vacuum within the vacuum hose.

16 Claims, 6 Drawing Sheets

(56) References Cited

U.S. PATENT DOCUMENTS

| | | | |
|---|---|---|---|
| 3,353,996 | A | 11/1967 | Hamrick |
| 3,520,725 | A | 7/1970 | Hamrick |
| 3,568,240 | A | 3/1971 | Hamrick |
| 3,682,500 | A | 8/1972 | Hamrick |
| 4,050,113 | A | 9/1977 | Wright et al. |
| 5,402,551 | A | 4/1995 | Workhoven et al. |
| 5,526,842 | A | 6/1996 | Christensen |
| 5,740,582 | A | 4/1998 | Harrelson, II |
| 5,794,305 | A | 8/1998 | Weger |
| 6,382,241 | B1 | 5/2002 | Setrum |
| 6,427,284 | B1 | 8/2002 | Harrelson, II et al. |
| 6,763,549 | B1 | 7/2004 | Peters |
| 7,010,829 | B2 | 3/2006 | Harman et al. |
| 7,322,070 | B2 | 1/2008 | Zimmerle et al. |
| 7,343,640 | B1 | 3/2008 | Robertson |
| 7,549,448 | B2 | 6/2009 | Ragner |
| 8,001,650 | B2 | 8/2011 | Trotter |
| 9,049,971 | B2 * | 6/2015 | Andrews ..... A47L 9/0036 |
| 2003/0051301 | A1 | 3/2003 | Morgan et al. |
| 2005/0022329 | A1 | 2/2005 | Harman et al. |
| 2007/0174991 | A1 | 8/2007 | Trotter |
| 2009/0188073 | A1 | 7/2009 | Gabric et al. |
| 2010/0050373 | A1 | 3/2010 | Kaffenberger et al. |
| 2011/0041282 | A1 | 2/2011 | Smith et al. |
| 2011/0119860 | A1 | 5/2011 | Marcil et al. |
| 2011/0219566 | A1 | 9/2011 | Dyson et al. |
| 2012/0079671 | A1 | 4/2012 | Stickney et al. |
| 2014/0246942 | A1 | 9/2014 | Greetham et al. |

FOREIGN PATENT DOCUMENTS

| | | | |
|---|---|---|---|
| JP | 2001161619 | A | 6/2001 |
| JP | 2002000516 | | 8/2002 |
| WO | 2013142992 | A1 | 10/2013 |

* cited by examiner

VACUUM HOSE STORAGE SYSTEM

RELATED APPLICATIONS

This application, U.S. patent application Ser. No. 14/388,716 filed Sep. 26, 2014 is a 371 of International PCT Application No. PCT/CA2013/050245 filed Mar. 25, 2013.

International PCT Application No. PCT/CA2013/050245 filed Mar. 25, 2013 claims benefit of U.S. Provisional Patent Application No. 61/616,367 filed Mar. 27, 2012.

The contents of all related applications cited above are incorporate herein by reference.

TECHNICAL FIELD

The invention relates to vacuum hose storage systems.

BACKGROUND

Central vacuum cleaners are commonly installed in homes, commercial establishments, and industrial facilities. Central vacuum cleaners typically comprise a vacuum unit configured to generate a partial vacuum and thereby induce a flow of air through a flexible vacuum hose. The vacuum unit is typically permanently mounted in a fixed location. The vacuum hose can either connect directly to the vacuum unit, or connect to one of one or more inlets which are connected to the vacuum unit by piping.

The vacuum hose may be maneuvered to collect material via suction at an open end of the vacuum hose. This material may include dirt, dust, debris, liquid, etc. The collected material is sucked through the vacuum hose and into a filter or a receptacle.

The vacuum hose should be long enough to reach from one or more vacuum inlets to all the areas that a user may wish to clean. In some situations, a very long vacuum hose will be required.

A vacuum hose can be inconvenient to store. A user may have to manually coil a vacuum hose. A user may have to find an appropriate storage location for a vacuum hose. In many places, especially apartments, there may be insufficient space to conveniently store a vacuum hose.

It would be advantageous to have an effective vacuum hose storage system which addresses some of the difficulties associated with using a conventional central vacuum cleaner.

SUMMARY

A vacuum hose storage system is contemplated, having a vacuum unit, a storage tube and a vacuum hose. The vacuum unit is fluidly connected to the storage tube and is operable to generate a partial vacuum within the storage tube. The vacuum hose can be drawn into the storage tube by the partial vacuum within the storage tube. While the system can be installed in a wall, a basement, a garage or an attic, it may also be installed in a specially designed enclosure such as a cabinet (for example, a kitchen cabinet) or in a mobile cart. When in a cabinet, the cabinet has upper and lower sections, and the storage tube is located within the lower section. Then the vacuum unit is located within the upper section.

This invention has a number of non-limiting aspects. One non-limiting aspect of the invention provides a vacuum hose storage system comprising a vacuum unit, a storage tube, and a vacuum hose. The vacuum unit is fluidly connected to the storage tube, the vacuum unit is operable to generate a partial vacuum within the storage tube, and the vacuum hose can be drawn into the storage tube by the partial vacuum within the storage tube.

In some embodiments, the vacuum hose storage system is installed within a wall, under a floor, in an attic, or within a cabinet (such as a kitchen cabinet).

In some embodiments, the cabinet comprises upper and lower sections, and the storage tube is located within the lower section.

In some embodiments, the vacuum unit is located within the upper section.

In some embodiments, the vacuum hose storage system comprises a vacpan. The vacpan comprises an opening in a wall, cabinet, kickboard, or the like; the opening is substantially at floor level; and the vacpan is fluidly connected to the vacuum unit such that the vacuum unit is operable to generate a partial vacuum within the vacpan.

In some embodiments, the vacuum hose storage system comprises a portable cart, and the vacuum unit and the storage tube are mounted to the cart.

In some embodiments, the portable cart comprises a plurality of wheels.

In some embodiments, the vacuum hose storage system comprises a cap, and the cap is attachable to one end of the vacuum hose to create a substantially airtight seal.

In some embodiments, the vacuum hose storage system comprises a pipe and an inlet, and the pipe is fluidly connected at one end to the vacuum unit and at the other end to the inlet.

In some embodiments, the vacuum hose is fluidly connectable to the inlet such that the vacuum unit is operable to generate a partial vacuum within the vacuum hose.

In some embodiments, the vacuum hose storage system comprises a storage tube opening located at the end of the storage tube.

In some embodiments, the storage tube opening is located within 5 feet of the inlet.

In some embodiments, the vacuum hose storage system comprises a plurality of pipes and inlets.

In some embodiments, the storage tube comprises two straight sides and two curved sides.

In some embodiments, the storage tube comprises PVC piping.

In some embodiments, the PVC piping is joined by male-female connections.

In some embodiments, the vacuum hose storage system is installed in an apartment.

Another non-limiting aspect of the invention provides a method for retrofitting a cabinet with a central vacuum cleaner, the method comprising installing a vacuum hose storage system within a cabinet, and installing a storage tube within a lower section of the cabinet.

BRIEF DESCRIPTION OF THE DRAWINGS

In drawings which illustrate non-limiting embodiments of the invention.

DESCRIPTION

Figure 1:
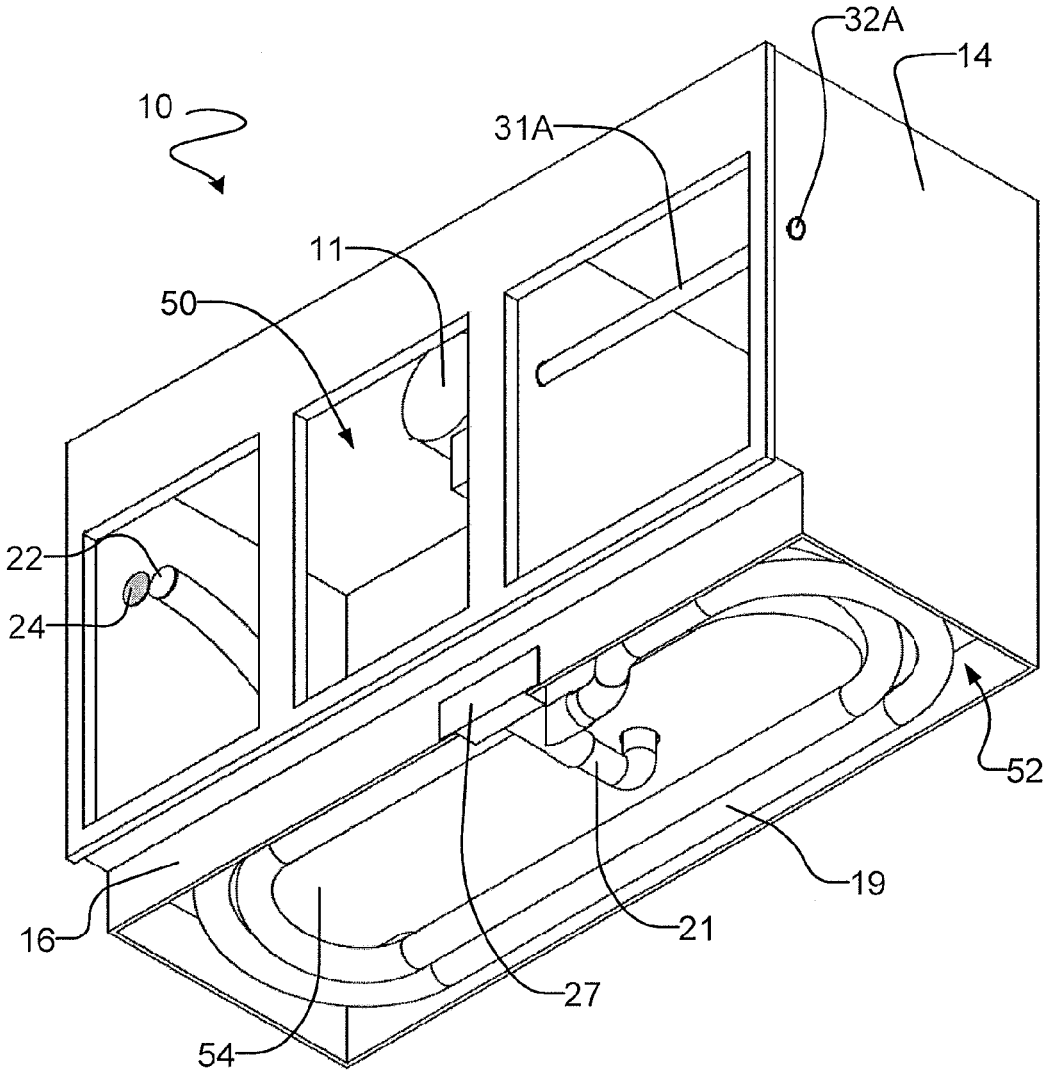
FIG. 1 is an isometric view of a vacuum hose storage system according to an example embodiment of the invention.

FIG. 1 illustrates a vacuum hose storage system 10 according to an example embodiment of the invention. A vacuum unit 11 is mounted within a cabinet 14, which may be a kitchen cabinet, a bathroom cabinet, or any other similar structure. Typically, cabinet 14 is box-like, with two sections, an upper section 50 and a lower section 52 forming the base of cabinet 14. Upper section 50 is generally accessible to a user. Lower section 52 is generally not accessible to a user. Lower section 52 is fronted by a kickboard 16. Vacuum unit 11 is mounted within upper section 50. Upper and lower sections 50, 52 are separated by a board 54.

In typical cabinets, lower section 52 is empty. Vacuum hose storage system 10 makes use of this previously unused space.

FIG. 1 is an isometric view, taken from beneath the floor on which the cabinet sits. Neither the floor nor the cabinet doors are shown in order to more clearly illustrate the features of the invention within cabinet 14.

In other embodiments of the invention, vacuum hose storage system 10 may be mounted inside a wall, a specially designed enclosure, a basement, a garage, an attic or any other suitable location.

A storage tube 19 is located within lower section 52 of cabinet 14 and behind kickboard 16. In the illustrated embodiment, storage tube 19 is fluidly connected to a vacpan pipe 21. Vacpan pipe 21 is fluidly connected to vacuum unit 11. The connection of vacpan pipe 21 to vacuum unit 11 is visible in FIGS. 2 and 3. Operation of vacuum unit 11 is operable to generate a partial vacuum within vacpan pipe 21 and storage tube 19.

Vacpan pipe 21 is fluidly connected to a vacpan 27. Vacpan 27 is mounted within kickboard 16 at floor level. Vacpan 27 comprises an opening with one edge that is substantially flush with the floor. The opening is normally covered, but when in operation it is uncovered and then dust, dirt, debris, liquid, etc. can be swept near vacpan 27 so that it may be sucked up through vacpan 27 and into vacpan pipe 21. Vacpan 27 may thereby operate as an alternative to a conventional dustpan.

In other embodiments, storage tube 19 may be fluidly connected to vacuum unit 11 directly. In other embodiments, storage tube 19 may be fluidly connected to vacuum unit 11 indirectly by other means, such as a pipe which is not vacpan pipe 21.

In other embodiments, storage tube 19 may be located within a wall, a specially designed enclosure, a basement, a garage, an attic, or any other suitable location. In some embodiments, storage tube 19 is located at a significant distance from vacuum unit 11. For example, vacuum unit 11 may be in the garage of a house and storage tube 19 may be within a cabinet of the kitchen of the house. In embodiments where storage tube 19 is located a significant distance from vacuum unit 11, a long pipe may be used to fluidly connect storage tube 19 to vacuum unit 11.

In the illustrated embodiment, storage tube 19 forms the approximate shape of a running track (i.e. two relatively longer straight sides and two relatively shorter curved sides). In other embodiments, storage tube 19 may form other shapes, such as oval, circular, or spiral. It may be advantageous for storage tube 19 to have a shape with minimal curvature. Excessive curvature may inhibit the smooth insertion and withdrawal of a vacuum hose (not shown) from storage tube 19. It may also be advantageous for storage tube 19 to take up relatively little space. It may also be advantageous for storage tube 19 to take up relatively little vertical space so that it may fit within lower section 52 of cabinet 14.

Storage tube 19 has a storage tube opening 22. In some embodiments (including the illustrated embodiment), storage tube opening 22 is mounted within the front of cabinet 14. A storage tube opening cover 24 is operable to cover storage tube opening 22. In some embodiments, storage tube opening cover 24 forms a substantially airtight seal over storage tube opening 22. In some embodiments (including the illustrated embodiment), storage tube opening cover 24 is flexibly mounted adjacent to storage tube opening 22. In some embodiments, storage tube opening cover 24 can close automatically.

Figure 2:
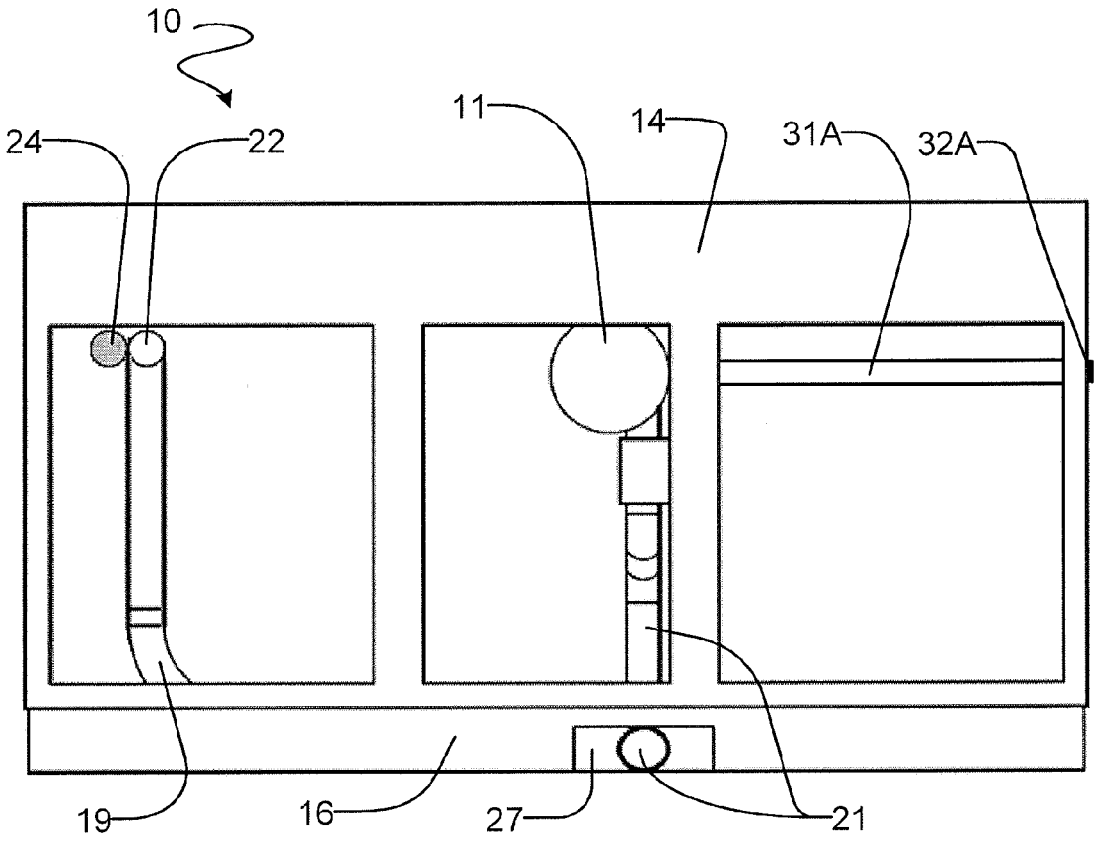
FIG. 2 is a perspective view of the vacuum hose storage system shown in FIG. 1.

FIG. 2 is a perspective view of the vacuum hose storage system 10 in FIG. 1.

Figure 3:
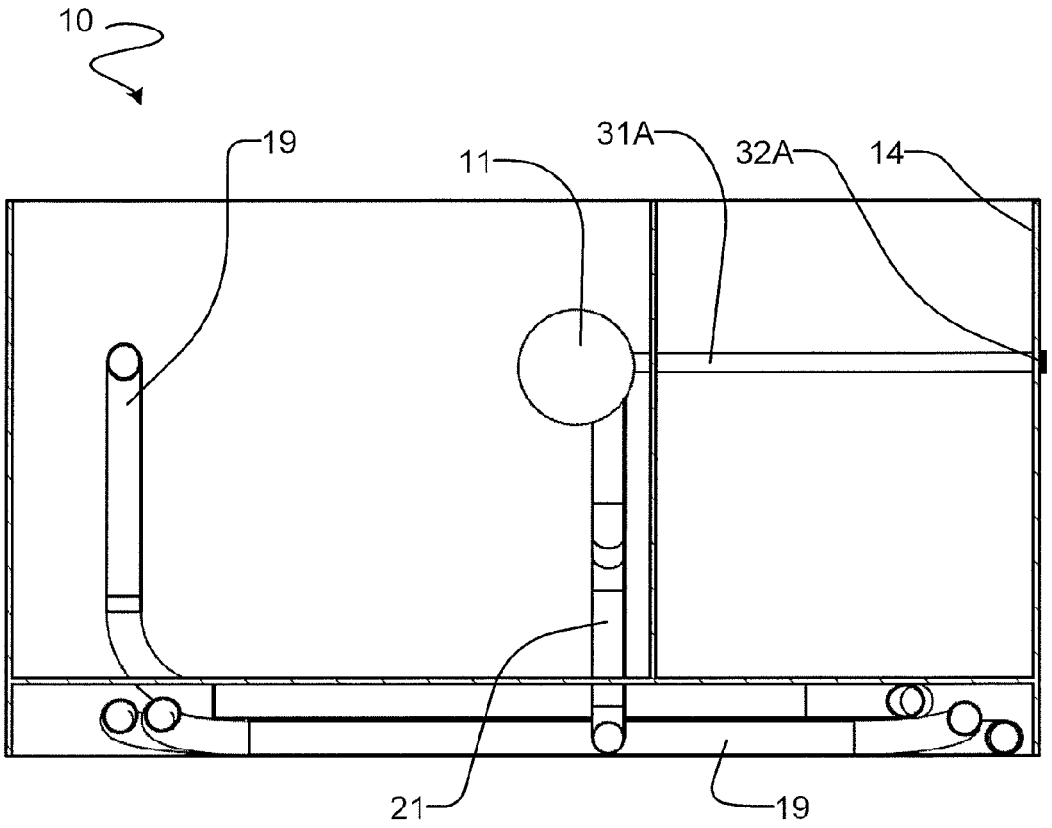
FIG. 3 is cutaway view of the vacuum hose storage system shown in FIG. 2.

FIG. 3 is a cut away view of the vacuum hose storage system 10 in FIG. 1.

Figure 4:
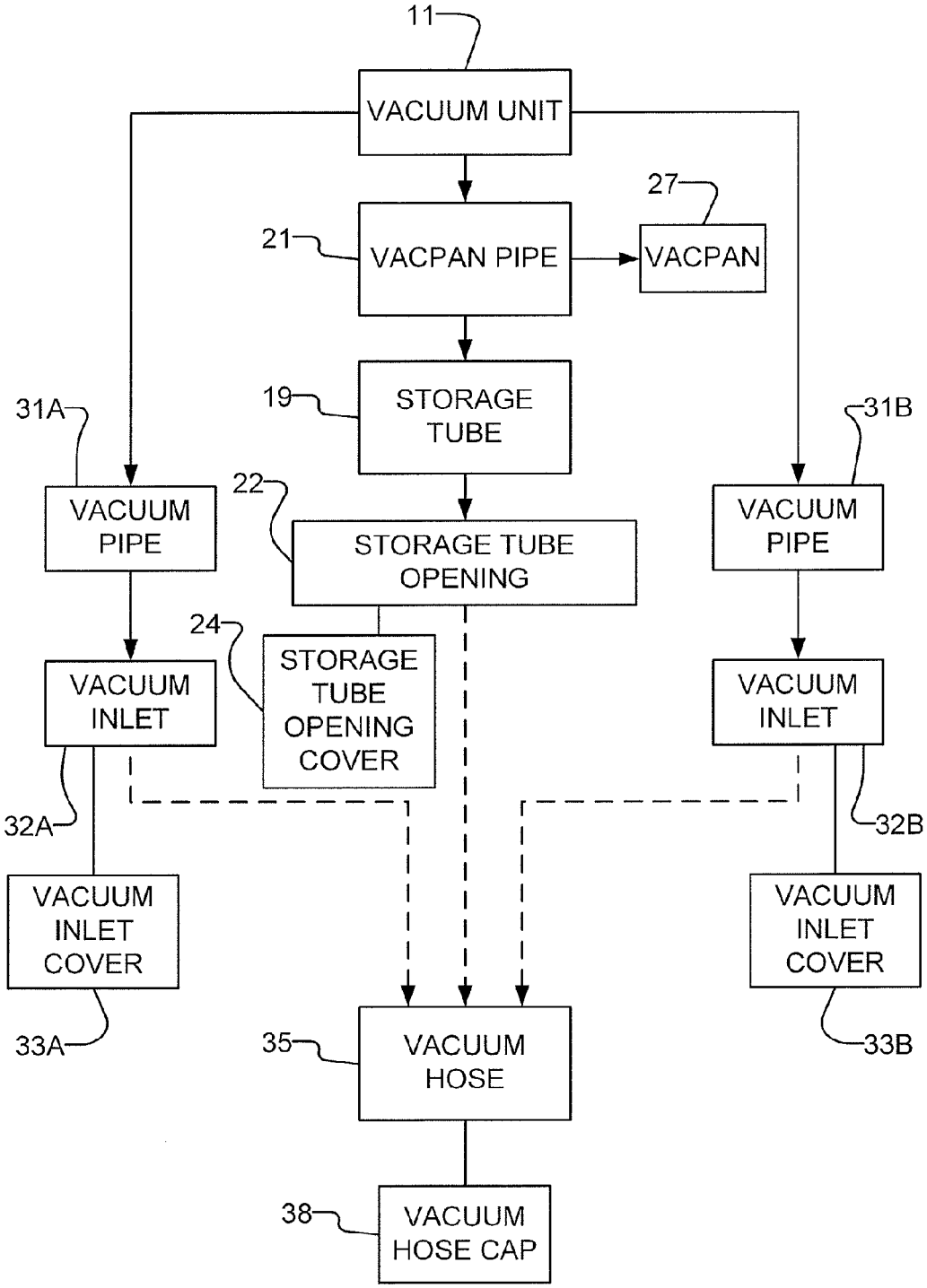
FIG. 4 is a schematic diagram of the vacuum hose storage system shown in FIG. 1.

FIG. 4 is a schematic diagram of the vacuum hose storage system in FIG. 1. Lines with arrows indicate fluid connections. Dotted lines with arrows indicate possible fluid connections depending on how the vacuum hose is being used at a particular time. As described above, vacuum unit 11 is fluidly connected to vacpan pipe 21, which is fluidly connected to storage tube 19 and vacpan 27. Storage tube 19 has a storage tube opening 22.

Vacuum pipes 31A and 31B are fluidly connected to vacuum unit 11. Vacuum unit 11 is operable to generate a partial vacuum within vacuum pipes 31A and 31B and storage tube opening 22. In other embodiments there may be other numbers of vacuum pipes, for example any number from 1 to 10.

Vacuum pipes 31A and 31B are fluidly connected to vacuum inlets 32A and 32B, respectively. Vacuum inlets 32A and 32B may be located a significant distance from vacuum unit 11. For example, vacuum unit 11 may be located in the garage of a house, and vacuum inlet 32A may be located in the upstairs bedroom of the house and vacuum inlet 32B may be located in the living room of the house.

In some embodiments, vacuum inlet 32A, or storage tube opening 22, or both, are located very close to vacuum unit 11, for example within 10, 5, or 2 feet. In some embodiments, vacuum inlet 32A is located very close to storage tube opening 22, for example within 10, 5, or 2 feet.

Vacuum inlets 32A and 32B may have vacuum inlet covers 33A and 33B, respectively. Vacuum inlet covers 33A and 33B may be operable to cover vacuum inlets 32A and 32B to form substantially airtight seals. In some embodiments, these covers may be pivotally mounted adjacent to vacuum inlets 32A and 32B, respectively. In some embodiments, these covers may be spring-loaded hinged covers which tend to cover the vacuum inlets if not urged open by a user.

Vacuum hose 35 can be fluidly connected to vacuum inlet 32A or vacuum inlet 32B. When vacuum hose 35 is fluidly connected to vacuum inlet 32A (or 32B), vacuum unit 11 is operable to generate a partial vacuum within vacuum hose 35. Vacuum hose 35 can be used to suck up dust, dirt, debris, liquid, etc.

Vacuum hose 35 has a smaller exterior diameter than the interior diameter of storage tube 19. In some embodiments, vacuum hose 35 has an exterior diameter of 1.75 inches and storage tube 19 has an interior diameter of 2 inches or 1.875 inches. In some embodiments vacuum hose 35 has a length that is approximately equal to, or very slightly longer than (e.g. approximately 1.5 inches longer than), the length of storage tube 19. These relative dimensions allow vacuum hose 35 to fit inside storage tube 19, but not entirely. The vacuum hose 35 can also be fitted with a collar (not shown) to prevent the hose 35 from slipping irretrievably into storage tube 19. Or, a stop can be provided within storage tube 19. Or, storage tube 19 can have a radial restriction at some point near its inner end to prevent vacuum hose 35 from slipping irretrievably into storage tube 19.

To store vacuum hose 35, a user may place a portion of vacuum hose 35 through storage tube opening 22 and into storage tube 19. Operation of vacuum unit 11 generates a partial vacuum within storage tube 19, sucking vacuum hose 35 into storage tube 19. Vacuum hose 35 is flexible and bends to conform to the shape of storage tube 19.

A vacuum hose cap 38 can be used to provide a substantially airtight seal over one end of vacuum hose 35. Vacuum hose cap 38 prevents air from flowing through vacuum hose 35, increasing the force of suction on vacuum hose 35 as it is sucked into storage tube 19. This may decrease the amount of time it takes for vacuum hose 35 to be sucked into storage tube 19. Vacuum hose cap 38 is removable, and is removed while vacuum hose 35 is being used for vacuuming.

In some embodiments, there is no vacuum hose cap 38. In such embodiments, a user may place his or her hand over the free end of vacuum hose 35 in order to increase the force of suction on vacuum hose 35. In some embodiments, it may not be necessary for a user to place his or her hand over the free end of vacuum hose 35 in order for the force of suction to be sufficient to draw vacuum hose 35 into storage tube 19.

Vacuum inlets 33A and 33B may be provided to seal vacuum inlets 32A and 32B, respectively. In some embodiments, it may be necessary to close vacuum inlet covers 33A and 33B in order for there to be sufficient suction at storage tube opening 22 to suck vacuum hose 35 into storage tube 19.

When a user wants to vacuum, the user may pull vacuum hose 35 out of storage tube 19 through storage tube opening 22. Then the user may connect an end of vacuum hose 35 to vacuum inlet 32A or 32B. Then the user may turn on vacuum unit 11 to generate a partial vacuum within vacuum hose 35.

Typically, vacuum inlet cover 33A will be used to cover vacuum inlet 32A whenever vacuum hose 35 is not connected to vacuum inlet 32A. Similarly, typically, vacuum inlet cover 33B will be used to cover vacuum inlet 32B whenever vacuum hose 35 is not connected to vacuum inlet 32B. Similarly, typically, storage tube opening cover 24 will be used to cover storage tube opening 22 whenever vacuum hose 35 is connected to vacuum inlet 32A or 32B. These steps may be taken to maximize the suction power in vacuum hose 35 during vacuuming.

Figure 5:
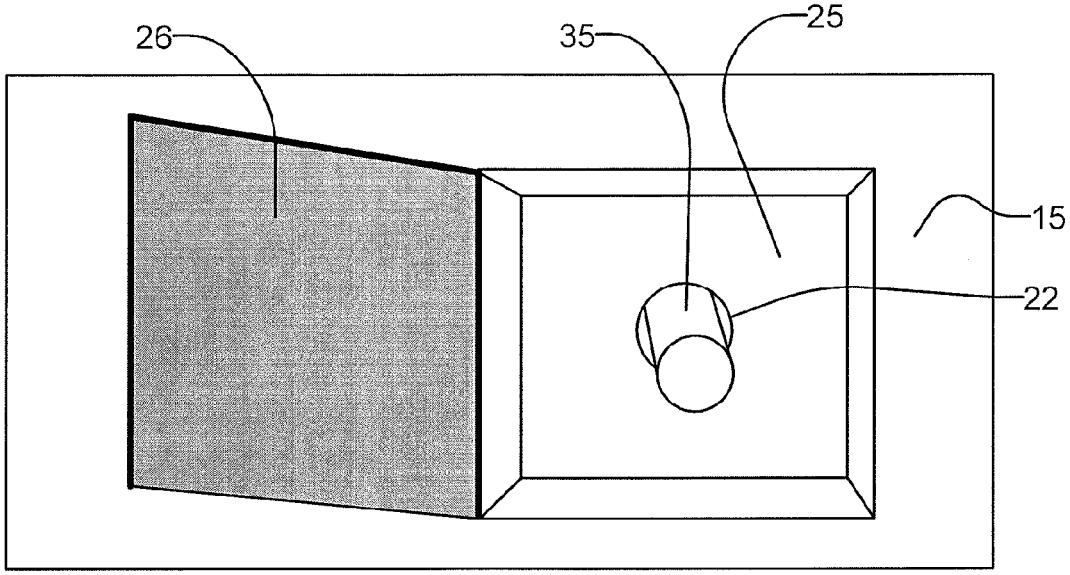
FIG. 5 is a perspective view of a storage tube opening according to an example embodiment of the invention.

FIG. 5 illustrates an example embodiment of storage tube opening 22. Recessed portion 25 may be recessed into or attached to cabinet wall 15. Storage tube opening 22 is mounted within the recessed portion 25 of cabinet wall 15. Vacuum hose 35 is shown fully inserted into storage tube 19. In this embodiment, vacuum hose 35 is slightly longer than storage tube 19 so that a small portion of vacuum hose 35 (e.g. 1.5 inches) will protrude out of storage tube opening 22. This makes it easier for a user to grasp vacuum hose 35 and pull it out of storage tube 19.

In the embodiment illustrated in FIG. 5, storage tube opening 22 does not have a storage tube opening cover 24 which covers the tube opening directly but rather, recessed portion 25 may itself have a openable cover 26. In some embodiments, cover 26 can be a spring-loaded hinged cover which tends to cover recessed portion 25 if not urged open by a user.

Figure 6:
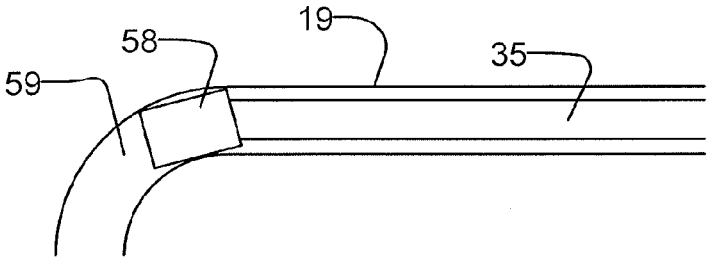
FIG. 6 is a cutaway view of a storage tube with a vacuum hose inside it according to an example embodiment of the invention.

FIG. 6 shows a portion of vacuum hose 35 within storage tube 19. In the illustrated embodiment, vacuum hose 35 has a connector piece 58. Connector piece 58 is shaped such that it cannot fit through a relatively sharp bend 59 within storage tube 19. Relatively sharp bend 59 is located near the end of storage tube 19 furthest from storage tube opening 22. Connector piece 58 acts to prevent vacuum hose 35 from being sucked too far into storage tube 19. In some embodiments, the distance from relatively sharp bend 59 to storage tube opening 22 is approximately equal to the length of vacuum hose 35.

Connector piece 58 can be used to connect vacuum hose 35 to vacuum inlets 32A and 32B.

Storage tube 19 may be comprised of sections of PVC piping or any other suitable material and structure. The interior of storage tube 19 should be relatively smooth so that it does not generate excessive friction with vacuum hose 35. The sections of PVC piping may be joined by standard male-female connections. In some embodiments, storage tube 19 may be made of a flexible hose, or storage tube 19 may have portions which are rigid and portions which are flexible. For example, straight portions of tube 19 may be rigid, and the curving portions flexible. This permits the vacuum hose 35 to be more readily accommodated by storage tube 19, since storage tube 19 can change its shape slightly in its flexible sections to allow, for example, connector piece 58 on vacuum hose 35 to pass through those sections.

Storage tube 19 may take on any suitable shape. In some embodiments, it may be desirable to ensure that no portion of storage tube 19 has a radius of curvature which is less than some threshold value. This threshold value may be related to the friction properties of vacuum hose 35 and/or of storage tube 19.

Figure 7:
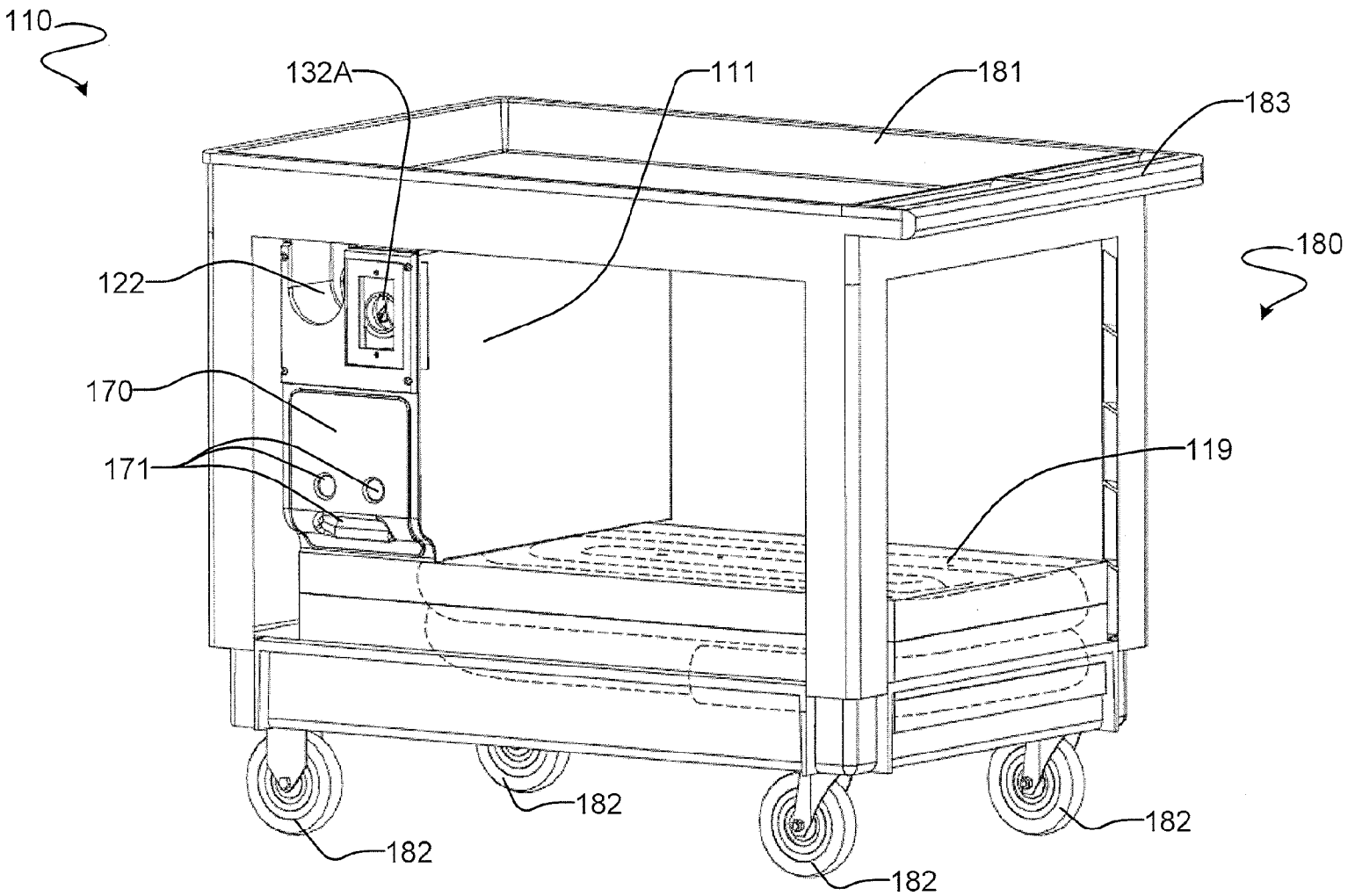
FIG. 7 is a isometric view of a portable vacuum hose storage system according to an example embodiment of the invention.

FIG. 7 shows an additional embodiment of the invention. Vacuum hose storage system 110 has many of the same features as vacuum hose storage system 10. Vacuum hose storage system 110 is mounted on a mobile cart 180

Cart 180 comprises a frame 181 supported by wheels 182. Wheels 182 permit a user to move cart 180 from one location to another. Cart 180 comprises a handle 183 which may be used by a user to control the movement of cart 180. In other embodiments of the invention, other means may be used to provide mobility to cart 180, for example coasters or rollers. In some embodiments, cart 180 may be moved along tracks. In some embodiments, cart 180 may be suspended from rigging.

A vacuum unit 111 is mounted within mobile cart 180. Vacuum unit 111 is fluidly connected to a storage tube 119, and is operable to generate a partial vacuum within storage tube 119.

Storage tube 119 has a storage tube opening 122. A vacuum hose (not shown) may be inserted into storage tube opening 122 and drawn into storage tube 119 by the partial vacuum generated by vacuum unit 111. The vacuum hose may thereby be conveniently stored while it is not in use.

Vacuum unit 111 is operable to generate a partial vacuum within vacuum inlet 132A. The vacuum hose is connectable to a vacuum inlet 132A so that a partial vacuum is generated within the vacuum hose. The vacuum hose may be used to vacuum collect material via suction at an open end of the vacuum hose.

Vacuum unit 111 comprises a storage bin 170. Storage bin 170 is mounted within vacuum unit 111. Material that is sucked through the vacuum hose is deposited into storage bin 170. Storage bin 170 may be removed from vacuum unit 111 so that the contents of storage bin 170 may be emptied. Storage bin 170 has finger holes 171 which allow a user to grip storage bin 170 in order to remove it from vacuum unit 111.

As will be apparent to those skilled in the art in the light of the foregoing disclosure, many alterations and modifications are possible in the practice of this invention without departing from the spirit or scope thereof.

What is claimed is:

1. A vacuum hose storage system comprising:

a storage structure defining an upper section and a lower section;

a vacuum unit supported within the upper section of the storage structure;

a storage tube; and a vacuum hose;

wherein:

the storage tube is arranged to define a first portion comprising first, second, third, and fourth side portions, where the first portion is arranged at a first vertical level, a second portion comprising first, second, third, and fourth side portions, where the second portion is arranged at the first vertical level, and a third portion arranged at a second vertical level, where the storage tube is configured such that the first, second, and third portions of the storage tube are arranged within the lower section of the storage structure, the first vertical level is below the second vertical level, and the second portion is at least partly surround by the first portion;

the vacuum unit is fluidly connected to the storage tube;

the vacuum unit is operable to generate a partial vacuum within the storage tube; and the vacuum hose can be drawn into the storage tube by the partial vacuum within the storage tube.

2. A vacuum hose storage system according to claim 1 wherein the storage structure is a cabinet.

3. A vacuum hose storage system according to claim 2 wherein the cabinet is a kitchen cabinet.

4. A vacuum hose storage system according to claim 1 wherein the storage structure is a cabinet, and the storage tube is behind a kickboard of the cabinet.

5. A vacuum hose storage system according to claim 1 wherein the storage structure is a rolling cart.

6. A vacuum hose storage system according to claim 5 wherein the portable cart comprises a plurality of wheels.

7. A vacuum hose storage system according to claim 1 further comprising a vacpan, wherein:

the vacpan comprises an opening in a wall, cabinet, kickboard, or the like;

opening is substantially at floor level; and the vacpan is fluidly connected to the vacuum unit such that the vacuum unit is operable to generate a partial vacuum within the vacpan.

8. A vacuum hose storage system according to claim 1 further comprising a cap, wherein the cap is attachable to one end of the vacuum hose to create a substantially airtight seal.

9. A vacuum hose storage system according to claim 1 wherein the first and third side portions of the first and second side portions of the first and second portions of the storage tube are straight and the second and fourth side portions of the first and second portions of the storage tube are curved.

10. A vacuum hose storage system according to claim 1 wherein the storage tube comprises PVC piping.

11. A vacuum hose storage system according to claim 10 wherein the PVC piping is joined by male-female connections.

12. A method for retrofitting a cabinet with a central vacuum cleaner, the method comprising installing the vacuum hose storage system according to claim 1 within a cabinet, and installing the storage tube within the lower section of the cabinet.

13. A vacuum hose storage system as recited in claim 1, in which the storage tube comprises a fourth portion, where the fourth portion of the storage tube:

defines a tube opening, and the fourth portion of the storage tube is at least partly arranged within the upper section of the storage structure such that the tube opening is accessible at a front portion of the storage structure above the lower section of the storage structure.

14. A vacuum hose storage system as recited in claim 1, in which the first and second portions of the storage tube takes the form of a loop.

15. A vacuum hose storage system as recited in claim 14, in which the first and second portions of the storage tube are both at least one of running track shaped, oval shaped, circular shaped, and spiral shaped.

16. A vacuum hose storage system as recited in claim 1, in which the storage tube defines at least one curved portion, where a curvature of the curved portion is predetermined to allow smooth insertion and withdrawal of the vacuum hose from the storage tube.

* * * * *